US009421412B2

(12) United States Patent
Eddy

(10) Patent No.: US 9,421,412 B2
(45) Date of Patent: Aug. 23, 2016

(54) BACK STRETCHING MACHINE

(71) Applicant: Mark Lynn Eddy, Mammoth Lakes, CA (US)

(72) Inventor: Mark Lynn Eddy, Mammoth Lakes, CA (US)

( * ) Notice: Subject to any disclaimer, the term of this patent is extended or adjusted under 35 U.S.C. 154(b) by 3 days.

(21) Appl. No.: 13/748,955

(22) Filed: Jan. 24, 2013

(65) Prior Publication Data

US 2013/0184127 A1 Jul. 18, 2013

Related U.S. Application Data

(63) Continuation-in-part of application No. 13/466,603, filed on May 8, 2012, which is a continuation-in-part of application No. 13/235,183, filed on Sep. 16, 2011, now abandoned.

(51) Int. Cl.

| | |
|---|---|
| ***A63B 21/002*** | (2006.01) |
| ***A63B 21/00*** | (2006.01) |
| ***A63B 21/16*** | (2006.01) |
| ***A63B 21/055*** | (2006.01) |
| ***A63B 23/04*** | (2006.01) |

(Continued)

(52) U.S. Cl.

CPC ..... *A63B 21/002* (2013.01); *A61H 1/0292* (2013.01); *A63B 21/0442* (2013.01); *A63B 21/055* (2013.01); *A63B 21/1627* (2013.01); *A63B 21/4009* (2015.10); *A63B 23/0405* (2013.01); *A61H 2201/1261* (2013.01); *A61H 2201/163* (2013.01); *A61H 2201/1652* (2013.01); *A61H 2203/0456* (2013.01); *A63B 2023/0411* (2013.01); *A63B 2208/0252* (2013.01)

(58) Field of Classification Search

CPC ..... A63B 21/002; A63B 21/0442; A63B 21/055; A63B 21/1419; A63B 21/1627; A63B 23/0405; A63B 2208/0252; A63B 2021/0411; A63B 1/00; A63B 21/1618; A63B 21/04; A63B 21/4009; A63B 2023/006; A61H 2201/1261; A61H 2201/163; A61H 2201/1652; A61H 2203/0456; A61H 2023/0411

USPC ..... 482/51, 91, 121–124, 128–135, 140, 482/142, 145, 904, 907; 601/23; 5/648–651

See application file for complete search history.

(56) References Cited

U.S. PATENT DOCUMENTS 1,734,238 A * 11/1929 Sweeney ..... 482/123
4,685,671 A * 8/1987 Hagerman et al. ..... 482/124

(Continued)

OTHER PUBLICATIONS

Anderson, Diane. "Side Attraction." Yoga Journal. Dec. 2009. Jul. 8, 2013 <http://www.yogajournal.com/practice/2740>.*

*Primary Examiner* — Oren Ginsberg
*Assistant Examiner* — Jennifer M Deichl
(74) *Attorney, Agent, or Firm* — Coastal Patent Law Group, P.C.

(57) ABSTRACT

An apparatus for stretching the lower back includes a waist garment configured for placement around a person's waist. It also includes at least one stretchable elastic element for interconnecting the waist garment with a surface. The elastic element is stretchable when interconnecting the waist garment with the surface from a materially biased configuration by a person wearing the waist garment and tensioning the stretchable elastic element by pushing away from the surface to thereby apply force to the person's back via the waist garment. The apparatus also includes at least one foot support element against which a person can push his foot to push away from the surface, thus imposing a therapeutic force on his lower back.

15 Claims, 3 Drawing Sheets

(51) Int. Cl.
*A61H 1/02* (2006.01)
*A63B 21/04* (2006.01)

(56) References Cited

U.S. PATENT DOCUMENTS 5,423,730 A * 6/1995 Hirsch ..... A63B 21/06 482/904
5,674,168 A * 10/1997 Wilkinson ..... 482/138
5,839,999 A * 11/1998 Pflugner ..... 482/140
6,267,711 B1 * 7/2001 Hinds ..... 482/121
7,104,935 B2 * 9/2006 Matsuoka ..... 482/124
2005/0227833 A1 * 10/2005 Wilkinson ..... 482/124
2008/0171643 A1 * 7/2008 Baudhuin ..... 482/148
2010/0204014 A1 * 8/2010 Hoffman ..... 482/8
2014/0031181 A1 * 1/2014 Agostini ..... A63B 21/0442 482/129

* cited by examiner

BACK STRETCHING MACHINE

This is a continuation-in-part of and claims priority to U.S. patent application Ser. No. 13/466,603 filed May 8, 2012. This application is also a continuation-in-part and claims priority to U.S. patent application Ser. No. 13/235,183, filed Sep. 11, 2011. Both U.S. patent application Ser. No. 13/466,603 and U.S. patent application Ser. No. 13/235,183 are incorporated by reference in their entirety herein.

I. FIELD OF THE INVENTION

The present application relates generally to back stretching machines.

II. BACKGROUND OF THE INVENTION

Back stretching machines have been introduced to help a person stretch their back, typically focused on the lower back, to alleviate pain and provide therapy. As understood herein, many such machines suffer from the drawback of imposing a one-size-fits-all stretching regime on users. For example, inclined or vertical boards on which a person hangs to allow gravity to pull the upper body down away from the elevated lower back places the entire weight of the upper body at the stretching point, and moreover can deleteriously cause higher blood pressure in the person's head. Moreover, a person typically must accept that the stretching force is imposed straight along the spine, when a person's particular back malady may be better treated by allowing the person to establish the force off-axis from the spine and to vary both the magnitude and direction of the stretching force.

SUMMARY OF THE INVENTION

Accordingly, a back stretching apparatus includes a foot bar assembly configured for being stationarily mounted as described herein. The foot bar assembly defines left and right rigid foot surfaces spaced laterally from each other such that a person lying supine can place his left and right feet respectively against the left and right rigid foot surfaces. The apparatus also includes elongated left and right elastic members that each have respective foot ends attachable to the foot bar assembly respectively at or adjacent to the left and right foot surfaces. Furthermore, the left and right elastic members each define a respective waist end opposite the respective foot end. Each of the left and right elastic members are materially biased to a short configuration in which the elastic member defines a first length, and are stretchable to an elongated configuration in which the elastic member defines a second length longer than the first length. In addition, the apparatus includes a waist belt connectable to the respective waist ends of left and right elastic members at left and right locations on the waist belt. The waist belt is configured for snug placement around the waist of a person such that a person wearing the waist belt around his waist and lying supine with the left and right elastic members interconnecting the waist belt and the foot bar assembly can place his left and right feet against the left and right foot surfaces, respectively, and push his feet against the left and right foot surfaces to urge the elastic members toward the second configuration to thereby place a stretching force on the person's lower back.

If desired, the elastic members may include a respective foot eyelet engaged with the foot end of each elastic member and a respective waist eyelet engaged with the waist end of each elastic member. Thus, the left and right foot eyelets may be respectively arranged on the foot bar assembly. Additionally, the left and right foot eyelets of the elastic members may be engageable with respective foot eyelets of the foot bar assembly using respective left and right foot connectors.

Furthermore, left and right belt eyelets may be arranged on the waist belt at substantially diametrically opposed portions of the waist belt, and the waist eyelets of the elastic members may thus be engageable with respective belt eyelets of the waist belt. Even further, if desired the waist eyelets of the elastic members may be engaged with respective belt eyelets of the waist belt using respective left and right belt connectors, which may be S-shaped in some embodiments.

Moreover, if desired the foot bar assembly may include a horizontal foot bar connectable to opposed door jambs. Even further, a padded surface may be used by the person to lie supine thereon and push against the horizontal foot bar between the door jambs.

Also, in some embodiments the foot bar assembly may be comprised of first and second bars slidably engageable with each other to at least partially stationarily mount the foot bar assembly (e.g., between opposed door jambs). The first bar may at least partially define the left rigid foot surface and the second bar may at least partially define the right rigid foot surface. Furthermore, a materially biased element may engage respective portions of the first and second bars such that the materially biased element exerts lateral (e.g., outward) force toward respective first ends of the first and second bars, where the first ends of the first and second bars are opposite respective second ends of the first and second bars that are slideably engageable with each other. Thus, the first ends may be engageable with opposed door jambs under material bias.

In another aspect, a method includes instructing a person to lie supine on a substantially horizontally-oriented surface with at least one foot positioned against a foot bar assembly above the surface. The method then includes instructing the person to don a waist belt positioned around the person's waist, and instructing the person to connect respective first ends of left and right elastic members to respective left and right portions of the foot bar assembly. In addition, the method includes instructing the person to connect left and right segments of the waist belt to respective second ends of the left and right elastic members. Thereafter, the method includes instructing the person to push his feet against the foot bar assembly to thereby push his head away from the foot bar assembly to provide a force on the person's back.

In still another aspect, an apparatus for stretching the lower back includes a waist garment configured for placement around a person's waist. The apparatus also includes at least one stretchable elastic element for interconnecting the waist garment with a surface. The elastic element is stretchable when interconnecting the waist garment with the surface from a materially biased configuration by a person wearing the waist garment and tensioning the stretchable elastic element by pushing away from the surface to thereby apply force to the person's back via the waist garment. The apparatus also includes at least one foot support element against which a person can push his foot to push away from the surface, thus imposing a therapeutic force on his lower back.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
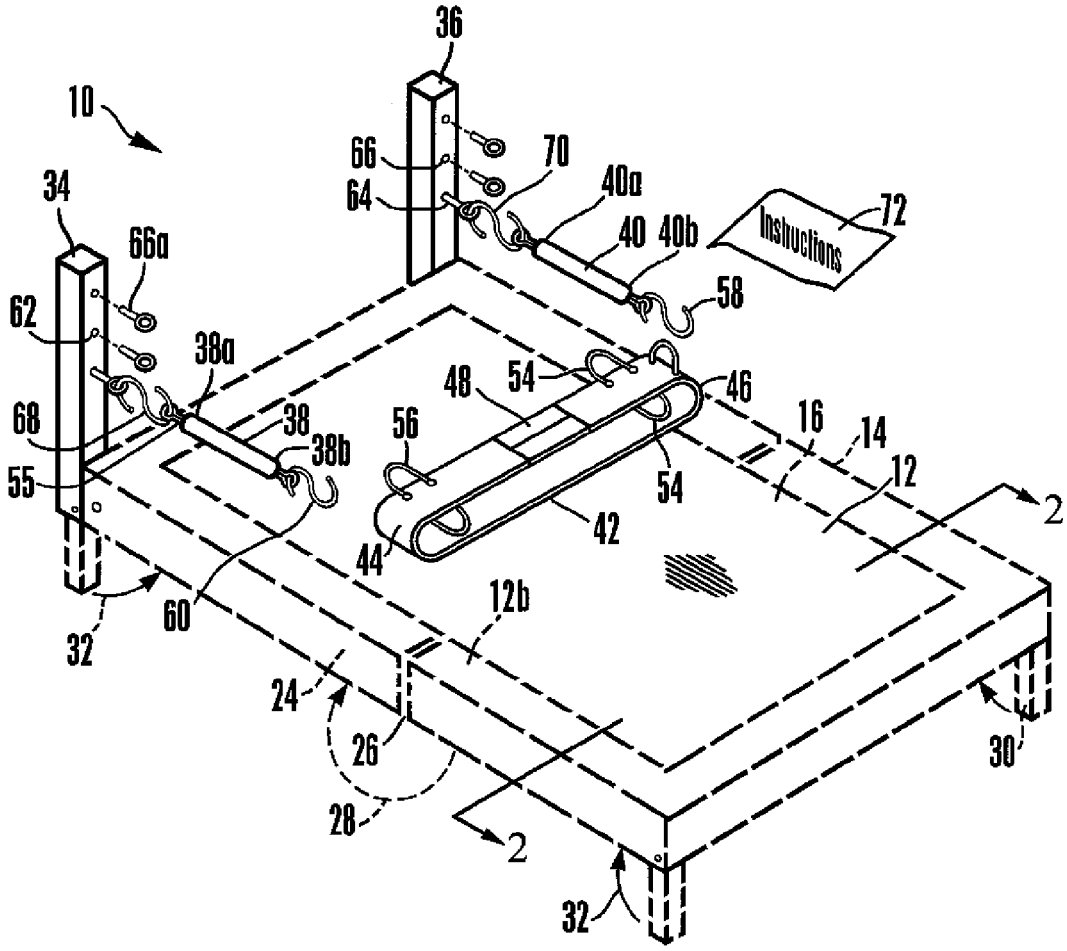
FIG. 1 is a perspective view of an example embodiment of the present back stretching machine.

Referring initially to FIG. 1, a back stretching apparatus 10 includes a base 12 on which a person can lie. The base 12 is generally parallelepiped-shaped and may be made of a suitable preferably rigid material such as Aluminum, Carbon fiber material, or plastic.

Figure 2:
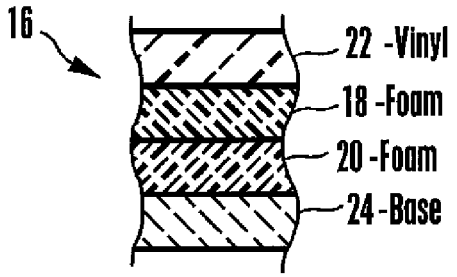
FIG. 2 is a cross-section taken along the line 2-2 in FIG. 1.

As shown, the base 12 includes a rectangular periphery 14 and in one implementation an upper padded surface 16 is bounded by the periphery 14. In other embodiments the upper padded surface 16 can extend completely to the edges of the base 12. Referring briefly to FIG. 2, an example upper padded surface 16 can include upper and lower layers 18, 20 of foam material covered by a protective vinyl cover 22, with the lower layer 20 being positioned against a bottom plate 24 of the base 12 and with the vinyl cover being substantially co-planar with the top surface of the periphery 14 of the base 12 shown in FIG. 1.

If desired, the base 12 may include left and right portions 12*a*, 12*b* that can be connected at a hinge joint 26 and that can be folded away from each other as shown in FIG. 1 into a therapy orientation in which the base 12 is oriented horizontally relative to the ground, upper padded surface 16 facing up. The portions 12*a*, 12*b* can be folded toward each other as indicated by the arrow 28 with the first portion 12*a* being folded flat against the second portion 12*b* for compact stowage. The portions 12*a*, 12*b* may be the same size as each other or one portion may be smaller than the other portion.

To raise the upper padded surface 16 higher above the ground for the convenience of the user than it otherwise would be, four rigid vertical legs 30 can be provided at each corner of the base 12 to support the base 12 above the ground in the therapy orientation. If desired, as illustrated by the arrows 32 the legs can be hinged to the base 12 so that the legs 30 are foldable between the vertical configuration shown, in which the legs 30 are perpendicular to the upper padded surface 16 of the base 12, and a horizontal configuration, in which the legs 30 are folded flat against the bottom 24 of the base.

FIG. 1 shows that left and right rigid foot bars 34, 36 are arranged at a first end of the base 12 and are and oriented vertically to extend above the upper padded surface 16 when the base 12 is in the therapy orientation. The foot bars 34, 36 may also be hingedly joined to the base if desired to fold down against the base for compact stowage, or may be removably joined to the base for the same purpose. In any case, the left and right foot bars 34, 36 are located along the first end and spaced laterally from each other (preferably at each left and right edge of the base). A cross-bar 37 may connect the foot bars 34, 36 and may be oriented perpendicular to the foot bars 34, 36 as shown. The cross-bar 37 can be made integrally with the foot bars 34, 36 or it can be made separately and then joined to the foot bars by, e.g., welding. While FIG. 1 shows that the cross-bar 37 is connected at the top of the foot bars, in other implementations the cross-bar 37 may be connected lower on the foot bars, e.g., at the midpoints of the foot bars. In any case, a person lying supine on the upper padded surface of the base can place his left and right feet respectively against the cross-bar 37 and/or against the left and right rigid foot bars 34, 36. The foot bars 34, 36 may be separate structures as shown or may be left and right portions of a single plate-like structure.

Figure 3:
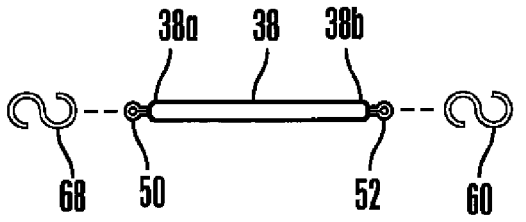
FIG. 3 is a side view of one of the elastic bands with S-clips in an exploded relationship with respective eyes.

Cross-referencing FIGS. 1 and 3, elongated left and right elastic plastic or rubber members 38, 40 such as bands each have respective foot ends 38*a*, 40*a* attached respectively to the left and right foot bars 34, 36. The left and right elastic members 38, 40 each define a respective waist end 38*b*, 40*b* opposite the respective foot end 38*a*, 40*a*, with each left and right elastic member 38, 40 being materially biased to a short configuration in which the elastic member 38, 40 defines a first length and being stretchable to an elongated configuration in which the elastic member 38, 40 defines a second length longer than the first length.

As also shown in FIG. 1, a waist belt 42 is connectable to the left and right elastic members 38, 40 at substantially diametrically opposite locations 44, 46 on the waist belt. By "substantially diametrically opposite" is meant between an angular difference of ninety degrees and two hundred seventy degrees, although locations other than substantially diametrically opposite may be used. The waist belt 42 is configured for snug placement around the waist of a person, and may include a detaching mechanism 48 such as a buckle to join and unjoin the ends of the waist belt at the buckle.

It may now be appreciated that a person wearing the waist belt 42 around his waist and lying supine on the upper padded surface 16 of the base 12 when the base 12 is in the therapy orientation with the left and right elastic members 38, 40 interconnecting the waist belt 42 and the left and right foot bars 34, 36 can place his left and right feet against the left and right foot bars 34, 36, respectively, and push his feet against the left and right foot bars 34, 36 to urge the elastic members 38, 40 toward the second (stretched) configuration, thereby placing a force on the person's lower back.

In example embodiments, as best illustrated in FIG. 3 a respective foot eyelet 50 is engaged with the foot end of each elastic member and a respective waist eyelet 52 is engaged with the waist end of each elastic member. The eyelets may be metal posts terminating in closed rings, with the posts being embedded in the elastic member, although other eyelet structure may be used. Also, right and left belt eyelets 54, 56 (in the example shown, loops of cord passed through the belt) can be arranged on the waist belt 42, and the waist eyelets 52 of the elastic members are engageable with respective belt eyelets of the waist belt using respective left and right belt connectors 58, 60. In the non-limiting example shown the belt connectors are S-shaped, it being understood that other connectors such as but not limited carabiner-type clips or other clipping or connecting structure such as detent and cavity connectors may be used, preferably so long as connection and disconnection is rendered simple and easy.

For completeness, note that although in some embodiments the belt eyelets 54, 56 may be at substantially diametrically opposed portions of the belt 42, it is to be understood that plural (e.g., five) belt eyelets may be positioned along each side of the belt 42 for selectively engaging the elastic members 38, 40, each one respective corresponding to similarly positioned eyelet on the other side of the belt 42, such that, e.g., the elastic members 38, 40 may be engaged with the belt 42 using the eyelets at positions not necessarily diametrically opposed to engage in a desired stretch such as, e.g., respective belt positions more in front of an individual and/or more behind an individual than at the side of the individual. Furthermore, it is noted that having corresponding sets of eyelets spaced laterally along respective sides of the belt 42, the belt 42 may be suitable for use as a one size fits all belt accommodating varying waist sizes.

Also, left and right foot eyelets 62, 64 may be arranged on the left and right foot bars 34, 36. The foot eyelets 62, 64 may be metal posts terminating in closed rings, with the posts being threaded into a respective opening 66 in the foot bar 34/36. If desired, each foot bar may include plural openings 66 spaced vertically from each other along the foot bar as shown, with each of the openings being engageable with a foot eyelet of the foot bar, such that a person can selectively engage a foot eyelet of each foot bar at a desired opening of the foot bar to thereby establish the elevation of the foot end of the respective elastic member. Or, each opening 66 may be provided with a respective eyelet 66*a* as shown. In any case, the foot eyelets 50 of the elastic members 38, 40 are engageable with respective foot eyelets 62, 64 of the foot bars 34, 36, in the non-limiting example shown using respective left and right foot connectors 68, 70 that, like the other connectors, may be S-shaped connectors or other appropriate connectors.

To instruct a person how to use the apparatus 10, a substrate 72 may be provided bearing instructions which instruct a person to lie flat on the upper surface 16 of the horizontally-oriented base 12, don the waist belt 42 by fastening it around the person's waist, and connect respective first ends of the left and right elastic members 38, 40 to the respective left and right foot bars 34, 36 above the upper surface of the base. The instructions may also instruct the person to connect left and right segments (e.g., the loops 54, 56) of the waist belt 42 to respective second ends of the left and right elastic members 38, 40, and then push his feet against the foot bars to thereby push his head away from the foot bars to provide a force on the person's back. In some embodiments the instructions may further advise the person to select a vertical location on the foot bars at which to attach the first end of each respective elastic member by means of the spaced openings 66 and eyelets 62/66*a*. The person may also be instructed to vary a force applied to the foot bars from leg to leg to thereby move an axis of stretch against the person's back.

Figure 4:
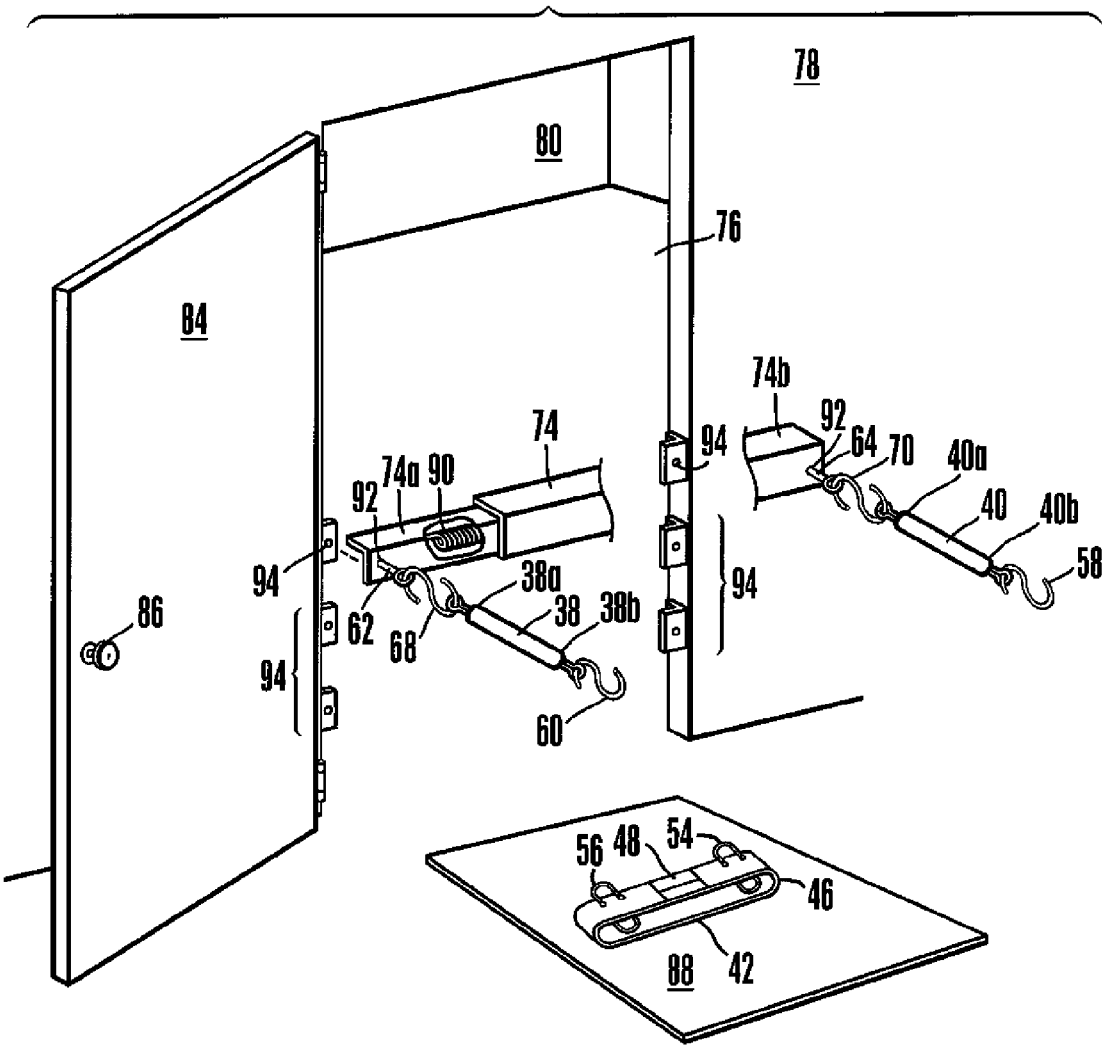
FIG. 4 is a perspective view of another example embodiment of the present back stretching machine.

Now in reference to FIG. 4, a perspective view of another example embodiment of the present back stretching machine is shown. FIG. 4 shows the waist belt 42 described above, as well as the left and right elastic members 38 and 40 also described above. However, in the exemplary embodiment of FIG. 4, a foot bar assembly 74 is disposed in a doorway 76 in a wall 78 such that the foot assembly 74 abuts opposing door jambs 80 of the doorway 76. It is to be understood that the foot bar assembly 74 may be positioned between the door jambs 80 such that portions 74*a*, 74*b* of the foot bar assembly 74 form a structure that is substantially horizontal and, e.g., parallel to the floor 82 also shown in FIG. 4. For completeness, note that as also shown, a door 84 with a door knob 86 is hingedly connected to a left side of the doorway 76 that is able to open and close (e.g., close completely) with or without the foot bar assembly 74 stationarily mounted in the door jambs 80 as described herein, and/or able to open and close with or without the brackets described below mounted in the jambs 80/doorway 76.

It is to be understood, as may be appreciated from FIG. 4, that the foot bar assembly 74 is configured for being stationarily mounted in the doorway 76, e.g., at a lower portion of the doorway 76 between the jambs 80 so that a person may lie down on the floor 82, or alternatively lie on a mat 88 (e.g., including the padded surface 16 described above, a yoga mat, and/or any other suitable or comfortable surface on which to lie, etc.) placed on the floor, and then place their feet against the foot bar assembly 74 while lying supine to exert force as described herein to stretch the person's back. Thus, it is to be understood that the foot bar assembly 74 includes and/or at least partially defines a left portion 74*a* that may be a bar and at least partially establishes a left rigid foot surface, as well as a right portion 74*b* that may be a bar and at least partially establishes a right rigid foot. Thus, the left and right rigid surfaces are spaced laterally from each other such that a person lying supine can place his left and right feet respectively against the left and right rigid foot surfaces.

In addition, in some embodiments the left and right portions 74*a*, 74*b* may be slidably engagable with each other to form a foot bar extending across the doorway 76 that is adjustable for varying widths of, e.g., various door jambs so that, e.g., the back stretching apparatus may be inserted into any given doorway and/or easily used at different locations. Thus, regardless of the particular doorway which a person wishes to use to stretch their back in accordance with present principles, the foot bar assembly 74 may nonetheless be stationarily mounted therein. However, it is to be understood that in addition to or in lieu of the foregoing, a unitary bar (as opposed to the portions 74*a*, 74*b*) may form part of the foot bar assembly 74 that extends between the door jambs 80.

Regardless, it is to be understood that in some example embodiments, the left and right portions 74*a*, 74*b* may be slidably engageable such that a materially biased element 90, such as, e.g., a spring, that is, e.g., inside the foot bar assembly 74 and extending between the left and right portions 74*a*, 74*b* can engage, e.g., an inner portion of each of the first and second portions 74*a*, 74*b* such that the materially biased element 90 can exert force on each of the portions 74*a*, 74*b* by pushing the left and right portions 74*a*, 74*b* away from their junction and toward their respective opposing door jambs 80, thereby at least partially engaging and/or stationarily mounting the foot bar assembly 74 within the doorway 76. Note, however, that the element 90 need not necessarily be engaged in an inner portion of each of the portions 74*a*, 74*b* and may be, e.g., a spring connector or other materially biased element residing outside the portions 74*a*, 74*b* but still engaged with them.

Nonetheless, it is to be further understood that the portions 74*a*, 74*b* may be engageable with each other in still other ways, such as using another type of sleeved configuration, and/or using a peg and hole configuration where, e.g., one of the portions 74*a*, 74*b* has at least one peg (e.g., a retractable peg extending orthogonal to and/or outward from the portion 74*a* or 74*b* under spring bias), while and the other of the portions 74*a*, 74*b* has a few holes spaced laterally thereon such that the peg may be depressed on one of the portions to thus allow the portions to slide together or apart to selectively establish a desired length, and the peg may then be released such that it is selectively inserted into one of the holes depending on a desired length of the foot bar assembly 74 to then engage and be secured to a doorway in accordance with present principles.

As yet another example, the portions 74*a*, 74*b* may have threaded portions such that they are threadably engageable with each other by e.g., screwing an end of one of the portions 74*a*, 74*b*, into an end of the other portion to establish a desired length to engage a doorway. Thus, in some embodiments the portions 74*a*, 74*b* may be telescoped and rotatable relative to each other (e.g., using a threaded structure) such that they can be turned relative to each other to establish a desired length and then be locked into place using, e.g., one of the methods described above such that the portions 74*a*, 74*b* are stationary relative to each other when, e.g., secured into a door jamb so that a person can place their feet against it to stretch their back without having the foot bar assembly 74 slip out of the doorway or otherwise become dislodged.

Still in reference to FIG. 4, note that left and right foot eyelets 62, 64 described above of the elastic members 38, 40 are engageable with respective openings 92 in the respective portions 74*a*, 74*b*. In addition to or in lieu of the eyelets 62, 64 being inserted directly into the openings 92, the eyelets 62, 64 may be engageable e.g., with respective foot eyelets on the foot bar assembly 74 not shown for clarity (e.g., protruding from the openings 92) using structures similar to the foot connectors 68, 70 described above.

Furthermore, to accommodate individuals of varying sizes and physical characteristics, plural sets of brackets 94 are spaced vertically on respective door jambs 80, e.g., all the way down to or substantially at the floor 82, such that each set is configured to receive the foot bar assembly 74 in a given substantially horizontal configuration. Thus, the foot bar assembly 74 may be selectively moved to a desired length by, e.g., compressing the (e.g., sleeved) portions 74*a*, 74*b* together under (e.g., spring) bias of the materially biased element 90, moving the bar up or down and into a desired set of brackets 94, and then allowing the portions 74*a*, 74*b* to extend outward toward their respective door jambs 80, e.g., under material bias to thereby respectively engage a bracket of a respective set of brackets 94. Thus, the foot bar assembly 74 may be positioned in any of the sets of brackets 94 spaced vertically along the door jambs 80 to accommodate a desired foot position of the individual using the back stretching apparatus described herein. Even further, it is to be understood that in addition to the three exemplary vacant sets of brackets 94 shown, a set of brackets 94 is also understood to exist, be occupied by, and be engaging the foot bar assembly 94 in the configuration of FIG. 4 (though not shown for clarity).

Moreover, in addition to or in lieu of the foregoing, respective vertical tracks along the door jambs 80 may be used rather than the sets of brackets 94 such that the foot bar assembly 74 may be slid therein and secured at a desired height for an even more refined height adjustment.

Still further, note that in some embodiments, openings for the left and right foot eyelets 62, 64 may be formed adjacent to the portions 74*a*, 74*b* in the respective door jambs 80. The foot bar assembly 74 extending across the doorway 76 may then be used to position an individual's feet to engage in back stretching in accordance with present principles, though it is to be understood that the user may also or alternatively position their feet on the respective door jambs 80 to stretch their back with the left and right foot eyelets 62, 64 engaged with either the door jambs 80, and/or the portions 74*a*, 74*b*, and/or another portion of the foot bar assembly 74.

Also in addition to or in lieu of the foregoing, it is to be understood that, with the eyelets 62, 64 engaged with openings in the door jambs 80, the foot bar assembly 74, the foot pedals described immediately below, or any other suitable structure on which to position one or more feet to engage in back stretching in accordance with present principles may be used as a foot support. E.g., a person may lie substantially on one side of the doorway 76, extend their feet through the doorway 76, and position their feet against a bed post on the other side of the doorway 76 to engage in back stretching.

Thus, it is to be understood that in some embodiments, the eyelets 62, 64 may be engaged with one surface (e.g., the foot bar assembly 74), while the individual's feet may be positioned on another surface (e.g., separate foot support of the back stretching apparatus) to engage in back stretching in accordance with present principles. However, it is to also be understood that in some exemplary embodiments, the surface of the foot bar assembly 74 with which the eyelets 62, 64 are engageable may also at least partially define foot supports in accordance with present principles.

Also in addition to or in lieu of the foregoing, left and right foot pedals for feet positioning may extend from the door jambs 80 toward the inner portion of the doorway 76 but not connect to each other at any point as the portions 74*a*, 74*b* do, and may be adjustable using any of the exemplary ways described above (e.g., brackets). In such an embodiment, openings for the eyelets 62, 64 may be formed in the pedals, and/or may be formed in the door jambs 80. Still further, any other suitable surface around or adjacent to the area where the person wishes to engage in back stretching may include openings for the eyelets 62, 64 to be secured to stretch one's back in accordance with present principles.

Accordingly, it may now be appreciated that the waist belt 42 as shown in FIG. 4 may be configured for snug placement around the waist of a person such that a person wearing the waist belt around his waist and lying supine with the left and right elastic members 38, 40 interconnecting the waist belt 42 and the foot bar assembly 74 can place his left and right feet against the portions 74*a*, 74*b*, respectively, and push his feet against the portions 74*a*, 74*b* to urge the elastic members 38, 40 toward an extending configuration to thereby place a stretching force on the person's lower back.

Furthermore, it is to be understood that instructions may be provided to instruct a person on how to use the configuration shown in FIG. 4, as well as any of the other configurations and/or embodiments described herein. Accordingly, the instructions may include instructing a person to lie supine on a substantially horizontally-oriented surface with at least one foot positioned against a foot bar assembly above the surface. The instructions may also include instructing the person to don a waist belt positioned around the person's waist, then instructing the person to connect respective first ends of left and right elastic members to respective left and right portions of the foot bar assembly. In addition, the instructions may include instructing the person to connect left and right segments of the waist belt to respective second ends of the left and right elastic members. Also, the instructions may include instructing the person to push his feet against the foot bar assembly to thereby push his head away from the foot bar assembly to provide a force on the person's back. Even further, in some embodiments the instructions may include instructing the person to select a vertical location of the foot bar assembly, and/or instructing the person to vary a force applied to the foot bar assembly from leg to leg to thereby move an axis of stretch against the person's back.

Figure 5:
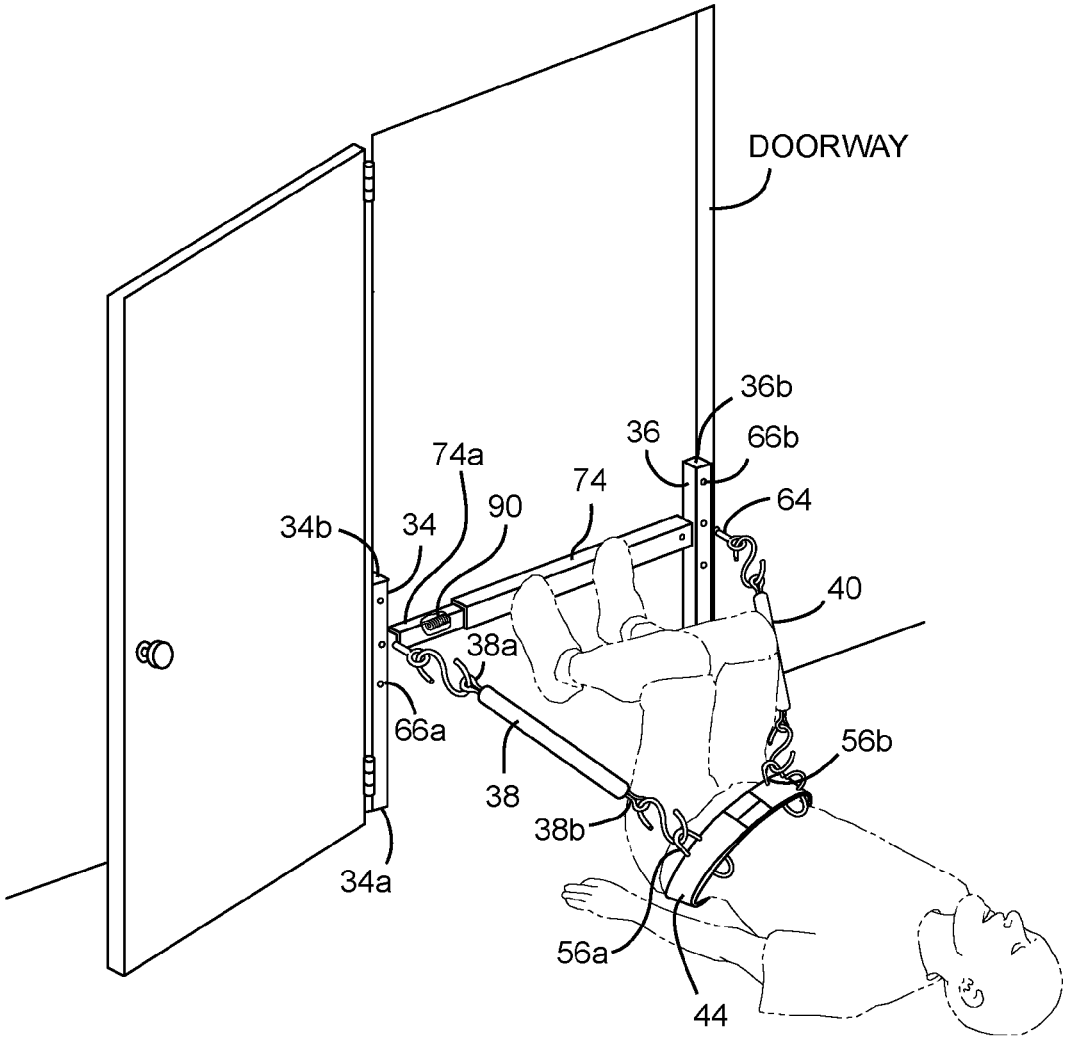
FIG. 5 shows the back stretching machine in accordance with another embodiment wherein the back stretching machine is positioned within a doorway.

FIG. 5 shows a back stretching machine positioned within a doorway. The back stretching machine includes: a first vertical bar 34 extending from a first bottom end 34*a* to a first top end 34*b* and having at least two first openings 66*a* each disposed between said first bottom end and said first top end; a second vertical bar 36 extending from a second bottom end to a second top end 36*b* and having at least two second openings 66*b* each disposed between said second bottom end and said second top end; a waist belt 44 comprising: a loop configured to extend around a user's waist, and a pair of belt eyelets 56*a*; 56*b*, wherein said pair of belt eyelets includes a right belt eyelet 56*b* positioned on a right side of the belt and a left belt eyelet 56*a* positioned on a left side of the belt; and a pair of elastic members 38; 40, each of the elastic members comprising a first connector 38*b* positioned at a first end and a second connector 38*a* positioned at a second end opposite of the first end, wherein the first connector 38*b* is configured to attach with one of: the right or left belt eyelets 56*a*; 56*b*, and wherein the second connector is configured to attach with one of the openings 66*a*; 66*b* of the first and second vertical bars; wherein the first vertical bar 34, second vertical bar 36, and the openings 66*a*; 66*b* disposed thereon, are each disposed within a doorway; the back stretching machine further comprising: a foot bar assembly 74, said foot bar assembly comprising a bar configured for placement between the first and second vertical bars 34; 36 within the doorway at a height between said openings 66*a*; 66*b*, wherein the foot bar assembly is configured to extend horizontally within the doorway and engage each of the first and second vertical bars, and wherein the foot bar assembly is adjustable in length between the first and second vertical bars for securing the foot bar assembly within the doorway. The foot bar assembly can include a first portion 74*a* slideably engaged with a second portion, and a materially biased element 90 as described above.

For completeness, note that a kit may be manufactured and provided to a user of the back stretching apparatus including at least some of the elements described above. E.g., the kit may include one of more of the belt 42, elastic members 38, 40, and/or the foot bar assembly 42 for use as foot supports, but note that an individual may still be required to drill holes in door jambs for placement of the eyelets 62, 64 in some embodiments.

Also for completeness, note that an individual need not necessarily be lying supine to stretch their back using the waist band and elastic members described above. For instance, the belts, elastic members, etc. may be used in a standing position such that the elastic members interconnect the waist belt to the floor or another surface, and the user may, e.g., engage in squatting to stretch their back. Other positions may be engaged in by an individual as well when donning the waist belt, such as, e.g., hanging upside down and pressing against a board or a ceiling with one's feet in accordance with present principles, or even lying face down or in the push-up position e.g., with feet positioned against foot supports protruding from door jambs.

Even further, note that bars forming all or part of the foot bar assembly need not necessarily be horizontal to a floor or other surface in all embodiments in order to undertake present principles. For example, a bar(s) forming an upright or upside down V may be used, an A frame formation, an X formation, and/or plural parallel horizontal bars. In addition, any of the bars and/or foot bar assemblies described herein may be, e.g., mounted and/or otherwise engaged with a wall rather than door jambs of a doorway, may be secured to a floor rather than a doorway (e.g., such that they protrude upward similar to the embodiment of FIG. 1 but are secured to the floor rather than to the base 12), may be suspended from and/or secured to a ceiling or underside of a table, etc.

Last, note that in some embodiments, a board or other structure besides a bar may be used in accordance with present principles. For instance, a wooden board may be positioned across a doorway. The board may even be rotatable angularly as desired with pivot points in respective door jambs to facilitate different back stretching while still secured in the doorway. Moreover, present principles recognize that such a board need not necessarily be positioned in a doorway, but may be secured to a wall and/or not secured to any building structure, instead only being connected to the waist belt itself (via the elastic members) such that a person can lie in the middle of a room with the elastic members connecting the belt on the person to the board, and then push their feet against the board (or bar) until the point of the person's full leg extension in order to engage in back stretching.

It is to be understood that the figures described herein generally show methods steps in conjunction with the devices, apparatuses, and elements disclosed herein.

While the particular BACK STRETCHING MACHINE is herein shown and described in detail, it is to be understood that the subject matter which is encompassed by the present invention is limited only by the claims.

What is claimed is:

1. A back stretching machine, comprising:

a first vertical bar extending from a first bottom end to a first top end and having at least two first openings each disposed between said first bottom end and said first top end;

a second vertical bar extending from a second bottom end to a second top end and having at least two second openings each disposed between said second bottom end and said second top end;

a waist belt comprising: a loop configured to extend around a user's waist, and a pair of belt eyelets, wherein said pair of belt eyelets includes a right belt eyelet positioned on a right side of the belt and a left belt eyelet positioned on a left side of the belt; and a pair of elastic members, each of the elastic members comprising a first connector positioned at a first end and a second connector positioned at a second end opposite of the first end, wherein the first connector is configured to attach with one of: the right or left belt eyelets, and wherein the second connector is configured to attach with one of the openings of the first and second vertical bars;

wherein the first vertical bar, second vertical bar, and the openings disposed thereon, are each disposed within a doorway;

the back stretching machine further comprising:

a foot bar assembly, said foot bar assembly comprising a bar configured for placement between the first and second vertical bars within the doorway at a height between said openings, wherein the foot bar assembly is configured to extend horizontally within the doorway and engage each of the first and second vertical bars, and wherein the foot bar assembly is adjustable in length between the first and second vertical bars for securing the foot bar assembly within the doorway.

2. The back stretching machine of claim 1, wherein the first vertical bar and second vertical bar are disposed at opposite sides of the doorway.

3. The back stretching machine of claim 1, comprising three pairs of openings, a first of the three pairs being positioned at a first height, a second of the three pairs being positioned at a second height above the first pair, and a third of the three pairs being positioned at a third height above each of the first and second pairs of openings; wherein the three pairs of openings includes the at least two openings of the first and second vertical bars.

4. The back stretching machine of claim 1, wherein said waist belt comprises a garment including a loop configured to extend around the user's waist.

5. The back stretching machine of claim 1, wherein the foot bar assembly comprises at least two slideably configurable portions, wherein the slideably configurable portions are adapted for adjustable fitment between the vertical bars.

6. The back stretching machine of claim 5, wherein said at least two slideably configurable portions form a sleeved configuration, wherein one of the two portions is configured to be sleeved within another of the portions such that each may translate slideably about one another to be configurable to a desired length for fitment within the doorway.

7. A back stretching machine configured for installation within a doorway, the doorway disposed in a wall, the doorway including opposing door jambs each disposed at an opposite side of the doorway, the back stretching machine comprising:

two or more pairs of openings configured within the doorway, a first of the two or more pairs of openings being positioned at a first height within the doorway, and a second of the two or more pairs of openings being positioned at a second height above the first pair of openings;

a waist belt comprising: a loop configured to extend around a user's waist, and a pair of belt eyelets, wherein said pair of belt eyelets includes a right belt eyelet positioned on a right side of the belt and a left belt eyelet positioned on a left side of the belt; and a pair of elastic members, each of the elastic members comprising a first connector positioned at a first end and a second connector positioned at a second end opposite of the first end, wherein the first connector is configured to attach to one of: the right or left belt eyelets, and wherein the second connector is configured to attach to one of the openings of the first and second vertical bars; and a foot bar assembly, said foot bar assembly comprising a bar configured for placement between the opposing door jambs of the doorway at a height between said openings, wherein the foot bar assembly is configured to extend horizontally within the doorway and engage each of the opposing door jambs, and wherein the foot bar assembly is adjustable in length between the opposing door jambs for securing the foot bar assembly within the doorway.

8. The back stretching machine of claim 7, each of said pairs of openings comprising a first opening disposed at a first side of the doorway, and a second opening disposed at a second side of the doorway opposite of the first side.

9. The back stretching machine of claim 8, wherein each of said openings is formed within a bracket, and said bracket is attached to one of the door jambs of the doorway.

10. The back stretching machine of claim 8, wherein each of said openings is formed within one of two vertical bars positioned within the doorway, wherein each of said two vertical bars are positioned at one of the first and second sides of the doorway, respectively.

11. The back stretching machine of claim 7, comprising three pairs of openings, a first of the three pairs being positioned at a first height, a second of the three pairs being positioned at a second height above the first pair, and a third of the three pairs being positioned at a third height above each of the first and second pairs of openings.

12. The back stretching machine of claim 7, wherein said waist belt comprises a garment including a loop configured to extend around the user's waist.

13. The back stretching machine of claim 7, wherein the foot bar assembly comprises at least two slideably configurable portions, wherein the slideably configurable portions are adapted for adjustable fitment between the door jambs of the doorway.

14. The back stretching machine of claim 13, wherein said at least two slideably configurable portions form a sleeved configuration, wherein one of the two portions is configured to be sleeved within another of the portions such that each may translate slideably about one another to be configurable to a desired length for fitment within the doorway.

15. The back stretching machine of claim 7, wherein the foot bar assembly is configured to be stationarily mounted within the doorway.

* * * * *